US006895762B1

(12) United States Patent
Lin

(10) Patent No.: US 6,895,762 B1
(45) Date of Patent: May 24, 2005

(54) REFRIGERATOR WITH A FREEZER AREA AND A REFRIGERATION AREA

(76) Inventor: Ching-Yu Lin, No. 30, Lane 455, Yuehmei Rd., Luodong Chen, Yilan Hsien (TW)

( * ) Notice: Subject to any disclaimer, the term of this patent is extended or adjusted under 35 U.S.C. 154(b) by 0 days.

(21) Appl. No.: 10/898,195

(22) Filed: Jul. 26, 2004

(51) Int. Cl.[7] ..... F25B 21/02
(52) U.S. Cl. ..... 62/3.3; 62/3.6; 62/371; 62/457.7
(58) Field of Search ..... 62/3.3, 3.36, 3.7, 62/371, 457.1, 457.2, 457.7

(56) References Cited

U.S. PATENT DOCUMENTS 5,809,785 A * 9/1998 Polkinghorne ..... 62/3.7
6,308,518 B1 * 10/2001 Hunter ..... 62/3.3
6,401,461 B1 * 6/2002 Harrison et al. ..... 62/3.61
6,412,286 B1 * 7/2002 Park et al. ..... 62/3.6
6,751,963 B2 * 6/2004 Navedo et al. ..... 62/6

* cited by examiner

*Primary Examiner*—Melvin Jones
(74) *Attorney, Agent, or Firm*—Rosenberg, Klein & Lee

(57) ABSTRACT

A refrigerator includes a hollow casing, an insulation layer securely attached to an inner side thereof, a freezer area defined in the casing and in communication with the opening of the casing, a refrigeration area defined in the casing and separated from the freezer area by a baffle. The refrigeration area is in communication with the opening. A first conductor and a second conductor are sandwiched between the baffle and the insulation layer. A thermoelectric cooling chip is selectively actuated for reducing and increasing air temperature. A first heat dissipation device is provided to dissipate heat from the thermoelectric cooling chip, such that heat conduction between the first conductor and the second conductor is able to conduct cold air from the thermoelectric cooling chip to the refrigeration area and the freezer area.

7 Claims, 3 Drawing Sheets

REFRIGERATOR WITH A FREEZER AREA AND A REFRIGERATION AREA

BACKGROUND OF THE INVENTION

1. Field of the Invention

The present invention relates to a portable refrigerator, and more particularly to a refrigerator divided into a freezer area and a refrigeration area to provide via a thermoelectric cooling chip different refrigeration effects to food items respectively received in the freezer area and the refrigeration area.

2. Description of Related Art

Conventionally, a refrigerator is a cabinet with multiple thermoelectric cooling chips respectively mounted in side faces of the cabinet to provide a cooling effect to food items such as cold beverage or vegetables stored in the refrigerator after the thermoelectric cooling chips are electrically actuated. This kind of refrigerator does provide the required cooling effect. However, when different cooling effects i.e. freezing environment and refrigeration environment are required to meet different food preservation conditions this conventional refrigerator is not able to accomplish the required goal. As a result, when a particular food is preserved in the conventional refrigerator, the food too soon becomes rotten due to the temperature inside the refrigerator being not as high as required.

To overcome the shortcomings, the present invention tends to provide an improved refrigerator to mitigate the aforementioned problems.

SUMMARY OF THE INVENTION

The primary objective of the present invention is to provide an improved refrigerator divided into a freezer area and a refrigeration area to provide different cooling effects to food items respectively received in the two areas via thermoelectric cooling chips such that different cooling effects are provided to meet different food preservation requirements.

Other objects, advantages and novel features of the invention will become more apparent from the following detailed description when taken in conjunction with the accompanying drawings.

DETAILED DESCRIPTION OF THE PREFERRED EMBODIMENT

Figure 1:
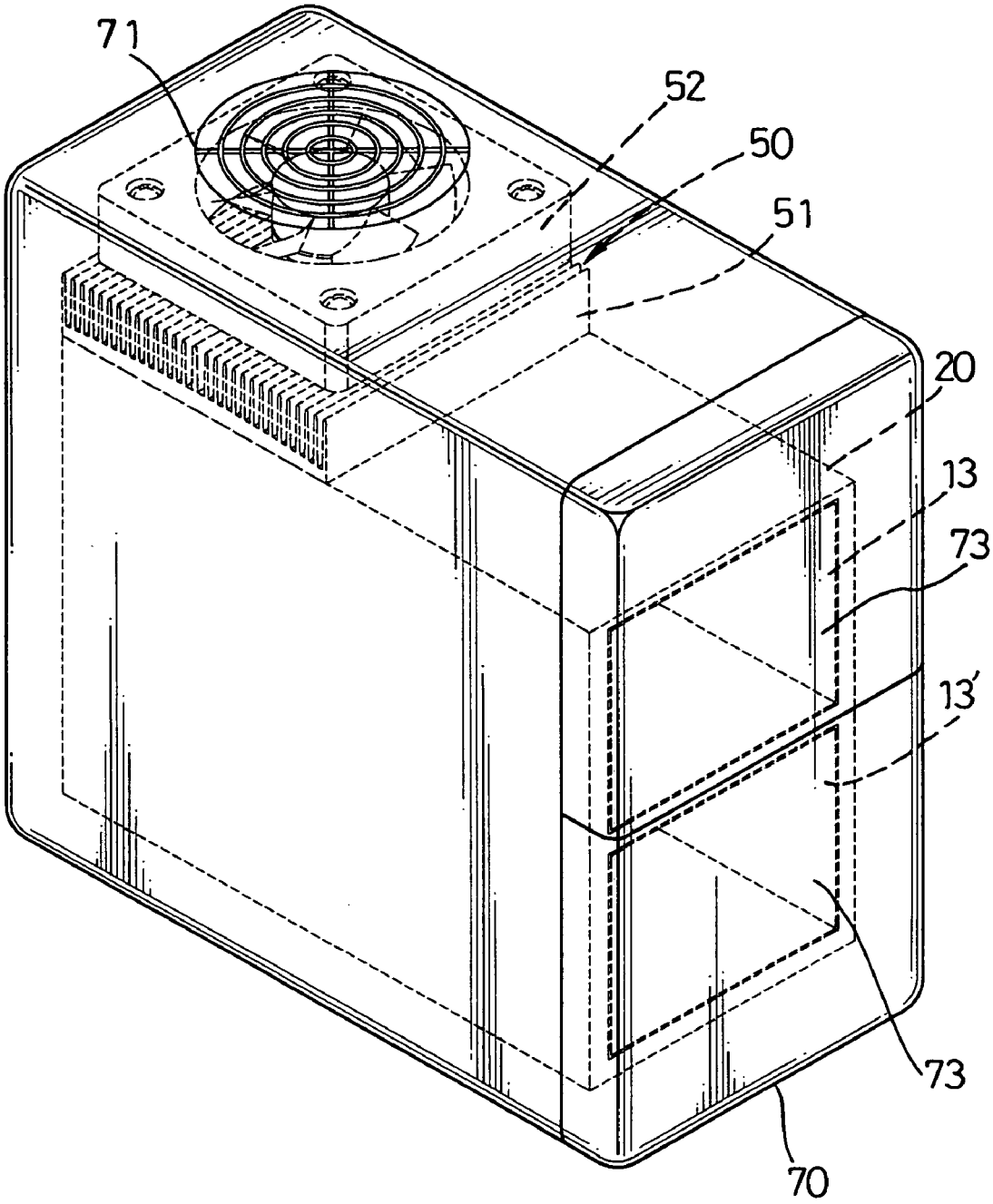
FIG. 1 is a perspective view of the refrigerator of the present invention.
Figure 2:
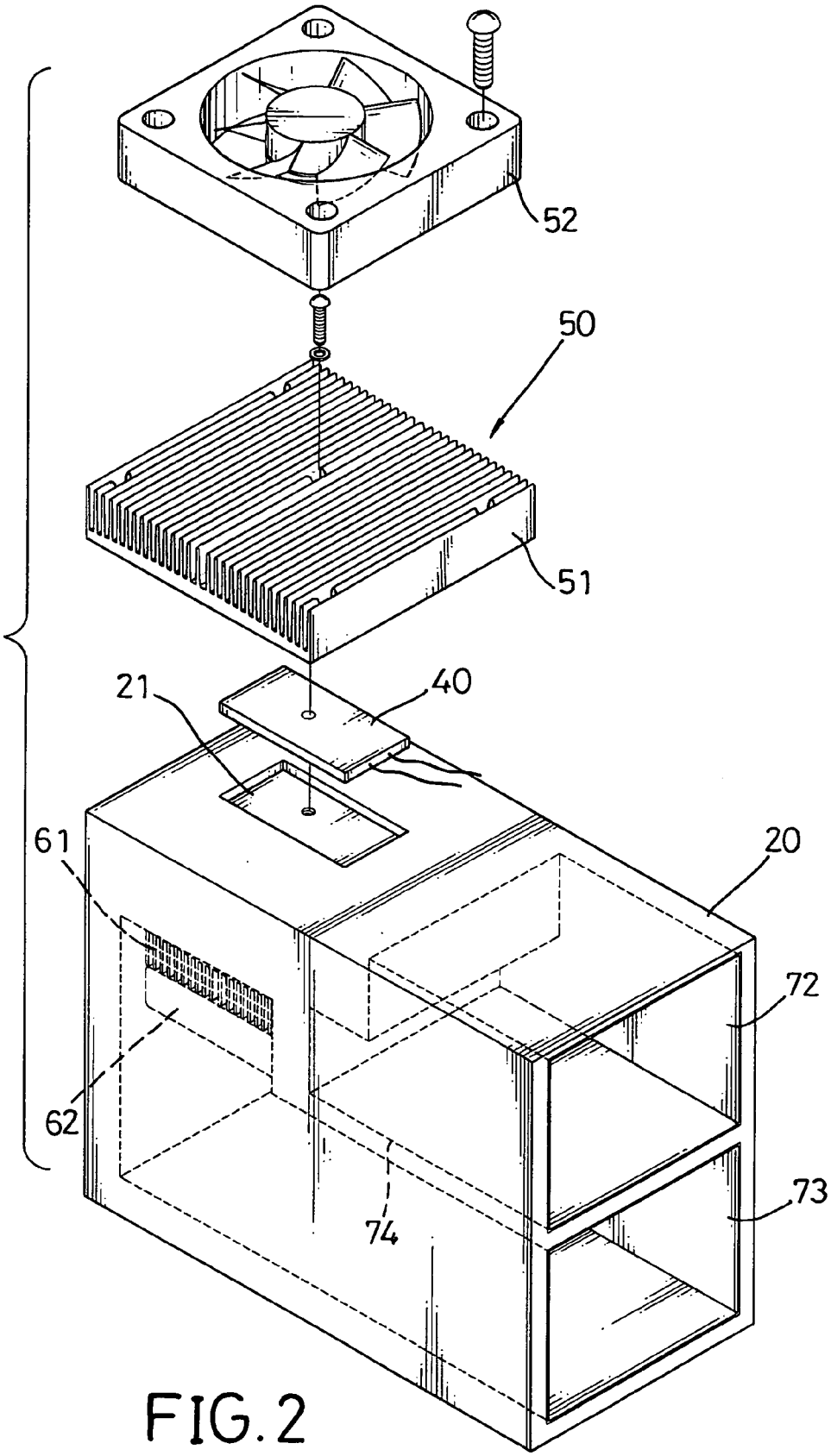
FIG. 2 is an exploded perspective view of the present invention.

With reference to FIGS. 1 and 2, it is noted that the refrigerator in accordance with the present invention includes a casing (70) and an insulation layer (20) attached to an inside of the casing (70). The casing (70) has an opening (71) defined in a side face of the casing (70) to communicate with an interior of the casing (70), a freezer area (72) in communication with the opening (71) and a refrigeration area (73) in communication with the opening (71). A baffle (74) is provided to isolate the refrigeration area

(73) from the freezer area (72). Furthermore, a pivot door (13, 13') is pivotally and respectively provided to the casing (70) to allow a user to have access to the freezer area (72) and the refrigeration area (73) individually.

Figure 3:
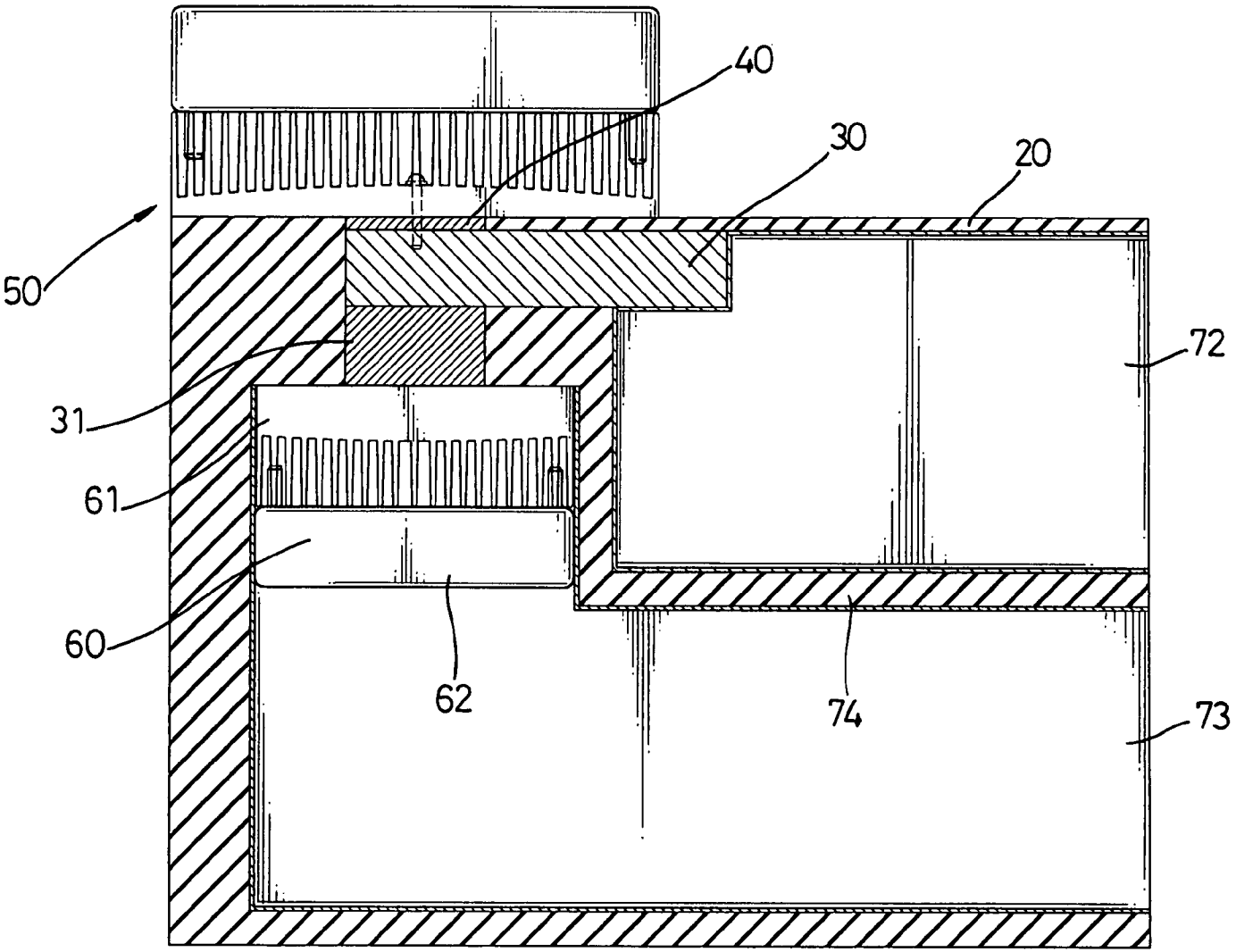
FIG. 3 is a cross sectional view showing the assembled refrigerator of the present invention, wherein the casing is removed for clarity.

With reference to FIGS. 2 and 3, after the casing (70) is removed for clarity, it is noted that the refrigerator of the present invention further includes a first conductor (30), a second conductor (31), a thermoelectric cooling chip (thermoelectric cooling chip) (40), a first heat dissipation device (50) and a cooling device (60). Preferably the first conductor (30) and the second conductor (31) are made of copper or aluminum. Preferably, the first conductor (30) has a volume larger than that of the second conductor (31) in the refrigeration area (73), the first conductor (30) is able to create greater cooling effect than that of the first conductor (31). That is, the first conductor (30) is able to provide a freezing effect and the second conductor (31) can only provide refrigeration effect.

From the depiction in FIG. 3, it is noted that the cooling device (60) is received in the refrigeration area (73) and mounted between a side face of the insulation layer (20) and a side face of the baffle (74). The cooling device (60) includes a cooling base (61) and a cooling fan (62) securely connected to fins of the cooling base (61). The second conductor (31) is placed on top of the cooling base (61) and sandwiched between an end face of the baffle (74) and a side face of the insulation layer (20). The first conductor (30) is securely engaged with the second conductor (31) and a portion of the first conductor (30) protrudes into the freezer area (72). The thermoelectric cooling chip (40) is received in a second opening (21) in the insulation layer (20) and a bottom face of the thermoelectric cooling chip (40) engages with a face of the first conductor (30). The second opening (21) corresponds to and communicates with the opening (71) of the casing (70).

The first heat dissipation device (50) includes a first heat sink (51) which is placed on top of the second opening (21) to allow a bottom face of the first heat sink (51) to engage with a top face of the thermoelectric cooling chip (40) and a first fan (52) which is securely received in the opening (71) as shown in FIG. 1.

When the refrigerator of the present invention is in operation, it is noted that after the thermoelectric cooling chip (40) is electrically actuated, the bottom side of the thermoelectric cooling chip (40) reduces the first conductor (30) air temperature, which in turn lowers the temperature in the freezer area (72) dramatically because the air inside the freezer area (72) contacts a portion of the first conductor (30) directly. Again, due to the actuation of the thermoelectric cooling chip (40), cold air is conducted from the first conductor (30) to the second conductor (31). Then after the second heat sink (61) receives the conducted cold temperature, the cooling fan (62) blows the cold air into the refrigeration area (73). In a different embodiment, the cold air may be conducted directly to the refrigeration area (73) by the second conductor (31) without the assistance of the cooling fan (62). Because the cold air comes from the indirect engagement with the thermoelectric cooling chip (40), the temperature inside the refrigeration area (73) is not as low as that inside the freezer area (72). Furthermore, heat generated by the actuation of the thermoelectric cooling chip (40) is conducted to the first sink (51) and then the first fan (52) blows heat out of the casing (70) from the opening (71). In this preferred embodiment of the present invention, the baffle (74) is integrally formed with the insulation layer (20). Furthermore, the first conductor (30) may be integrally formed with the second conductor (31).

Therefore, the refrigerator of the present invention is able to provide two different cooling effects to meet different food preservation requirements.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A portable refrigerator comprising:

a hollow casing having an opening defined in a side face thereof and a pivot door pivotally connected to a side face of the hollow casing to have access to an interior of the hollow casing;

an insulation layer securely attached to an inner side of the hollow casing and having a second opening defined in communication with the opening of the casing;

a freezer area defined in the casing and in communication with the opening;

a refrigeration area defined in the casing and separated from the freezer area by a baffle, the refrigeration area being in communication with the opening;

a first conductor sandwiched between an end face of the baffle and a side face of the insulation layer;

a second conductor on top of the first conductor to securely engage with the first conductor;

a thermoelectric cooling chip selectively actuated for reducing and increasing air temperature from two opposite side faces thereof, the thermoelectric cooling chip being supported by a side face of the second conductor; and a first heat dissipation device located on top of the second opening and received in the opening of the casing to dissipate heat from the thermoelectric cooling chip, such that heat conduction between the first conductor and the second conductor is able to conduct cold air from the thermoelectric cooling chip to the refrigeration area and temperature inside the freezer area is lower than that in the refrigeration area because a portion of the second conductor which is indirectly in engagement with the thermoelectric cooling chip protrudes into the freezer area.

2. The refrigerator as claimed in claim 1, wherein the first heat dissipation device includes a first heat sink and a first fan such that the heat from the thermoelectric cooling chip is able to be dissipated by the first fan.

3. The refrigerator as claimed in claim 2 further comprising a cooling device sandwiched between a side face of the baffle and a side face of the insulation layer to facilitate heat conduction to the refrigeration area, the second heat dissipation including a cooling base directly in engagement with the first conductor and a cooling fan for blowing air to the refrigeration area.

4. The refrigerator as claimed in claim 1, wherein the first conductor and the second conductor are integrally formed.

5. The refrigerator as claimed in claim 3, wherein the first conductor and the second conductor are integrally formed.

6. The refrigerator as claimed in claim 4, wherein the first conductor and the second conductor are made of a material selected from a group consisting essentially of copper and aluminum.

7. The refrigerator as claimed in claim 5, wherein the first conductor and the second conductor are made of a material selected from a group consisting essentially of copper and aluminum.

* * * * *